US005107869A

United States Patent [19]

Henry

[11] Patent Number: 5,107,869

[45] Date of Patent: Apr. 28, 1992

[54] COMPASS AND RULER COMB

[76] Inventor: Randy M. Henry, 11116 Aqua Vista St., #27, North Hollywood, Calif. 91602

[21] Appl. No.: 659,708

[22] Filed: Feb. 25, 1991

[51] Int. Cl.[5] ..... A45D 24/34

[52] U.S. Cl. ..... 132/213.1; 132/148

[58] Field of Search ..... 132/213, 213.1, 214, 132/148

[56] References Cited

U.S. PATENT DOCUMENTS

| | | | |
|---|---|---|---|
| 533,466 | 2/1895 | Howard et al. | 132/214 |
| 938,040 | 10/1909 | Caldwell | 132/214 |
| 2,510,943 | 6/1950 | Arnold | 132/214 |
| 2,562,421 | 7/1951 | Hendra | 132/214 |
| 2,622,603 | 12/1952 | Claps | 132/214 |

FOREIGN PATENT DOCUMENTS

| | | | |
|---|---|---|---|
| 0560041 | 6/1923 | France | 132/214 |

*Primary Examiner*—Gene Mancene
*Assistant Examiner*—Adriene B. Lepiane
*Attorney, Agent, or Firm*—Allan M. Shapiro

[57] ABSTRACT

Tne hairdresser's comb of this invention has several structures which aid in increasing the accuracy of cutting the hair. The features include an adjustable angle stop so that a section of hair can be combed out and held at the proper angle with respect to the head and an adjustable finger stop so that the section of hair clamped between the fingers can be held at an accurate distance from the head for cutting that section of the hair.

25 Claims, 1 Drawing Sheet

FIG. 1
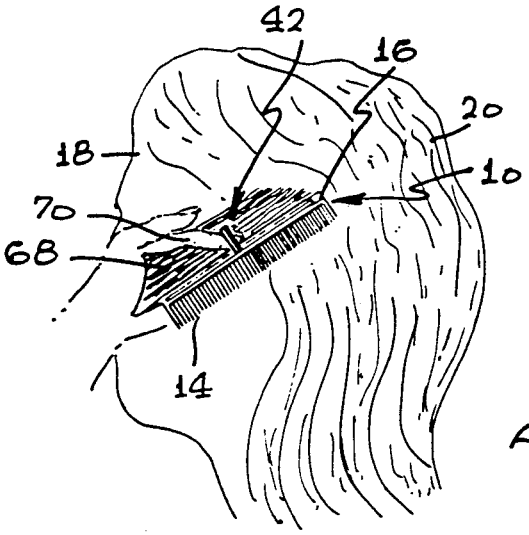
FIG. 6
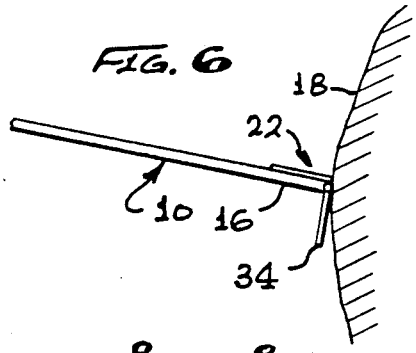
FIG. 7
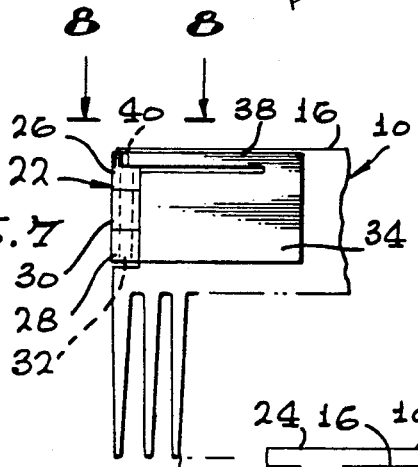
FIG. 2
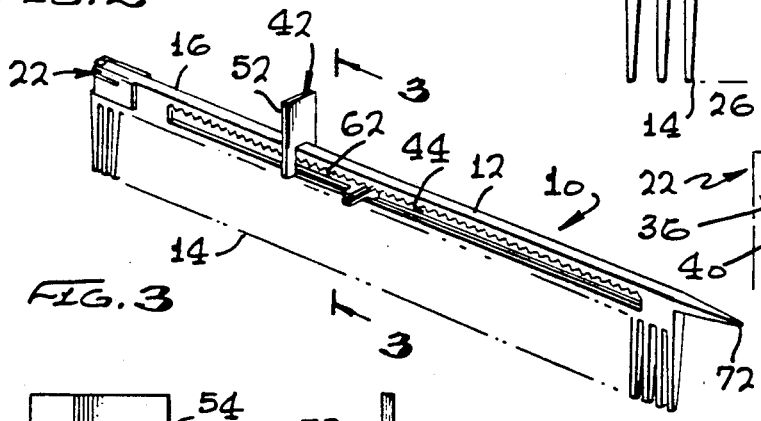
FIG. 3
FIG. 8
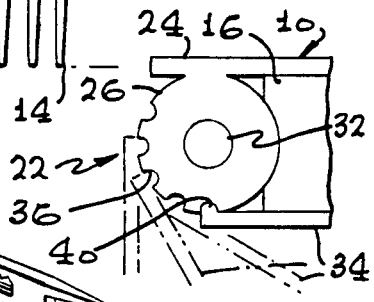
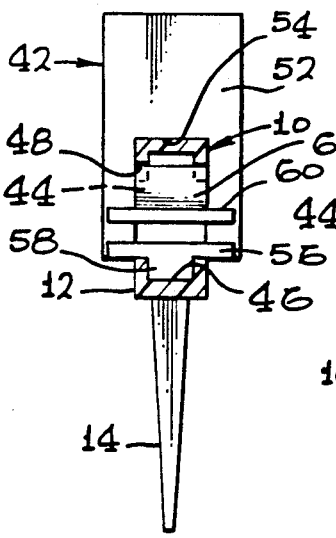
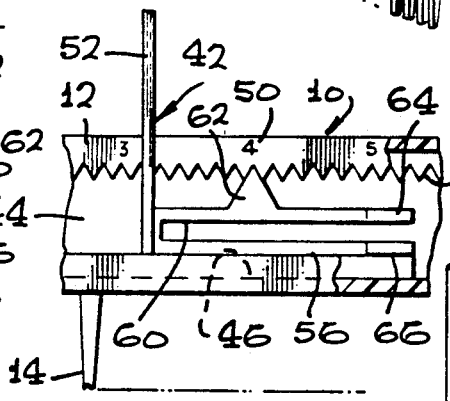
FIG. 4
FIG. 5
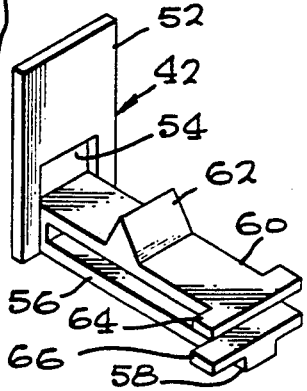

COMPASS AND RULER COMB

FIELD OF THE INVENTION

This invention is directed to a compass and ruler comb for precision haircutting. Features included on the comb are an adjustable angle stop to gauge the angle of a section of hair with respect to the head and an adjustable finger stop so that the section of hair clamped between the fingers can be held at the proper length for proper cutting of that section of the hair.

BACKGROUND OF THE INVENTION

In the cutting of men's and women's hair to a particular style, two important factors are involved. The first is elevation. Elevation is the angle at which a section of hair is held with respect to the point of the head to which the hair is attached, preparatory to cutting. The second is length. A section of hair is combed out and held at the proper elevation angle between the index and middle fingers on the left hand. These fingers clamp the hair, and the cut is made outside of the fingers (away from the head). These factors are principal among the various factors which influence and form the ultimate shape of the finished haircut. In present practice, elevation is not measured, but is estimated. The positioning of the clamped fingers on the section of hair is not measured, but is estimated. Thus, present-day haircutting is less than precise.

SUMMARY OF THE INVENTION

In order to aid in the understanding of this invention, it can be stated in essentially summary form that it is directed to a compass and ruler comb which has built-in structure both for measuring the elevation angle and measuring the finger clamp position before cutting for precision haircutting. The angular elevation measurement is provided by an angle stop mounted on the end of the comb and adjustable to the selected elevation angle. The haircutting length is measured by an adjustable finger stop against which one or more of the hair-clamped fingers is engaged so that the clamped fingers hold the section of hair at a precise preselected distance from the head prior to cutting.

It is thus an object and advantage of this invention to provide a comb which has a compass thereon for measuring elevation so that a section of hair can be drawn out at the correct elevation.

It is another object and advantage of this invention to provide a hairdresser's comb which has a finger stop thereon so that the index and middle fingers which are clamped on a section of hair can be held at a predetermined distance from the head so that cutting can be accurately accomplished.

It is a further object and advantage of this invention to provide a hairdresser's comb which has both an adjustable compass and an adjustable finger stop thereon so that the same comb can be employed to accurately show the correct elevation of a section of hair and accurately locate the clamping finger so that precision haircutting can be readily accomplished.

It is another object and advantage of this invention to provide a hairdresser's comb which has multiple functions beyond that of combing and wherein the hairdresser's comb is structured in such a way that it can be economically manufactured and, thus, provided to a broad segment of the market.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a perspective view of the compass and ruler comb of this invention, shown in use, defining both elevation and length of a section of hair, employing the angle stop and finger stop of the hairdresser's comb.

FIG. 2 is an isometric view of the compass and ruler comb of this invention on a larger scale.

FIG. 3 is an enlarged section taken generally along line 3—3 of FIG. 2.

FIG. 4 is an enlarged side elevational view, with parts broken away and parts taken in section, showing the details of the finger stop on the comb.

FIG. 5 is an isometric view of the finger stop separated from the comb.

FIG. 6 is a view of the comb held against the head, showing the application of the angle stop.

FIG. 7 is an enlarged detail of the angle stop end of the comb, with parts broken away.

FIG. 8 is a plan view of the angle stop portion of the comb, as seen generally along line 8—8 of FIG. 7.

DESCRIPTION OF THE PREFERRED EMBODIMENT

The compass and ruler comb of this invention is generally indicated at 10 in FIGS. 1, 2 and 6. The comb 10 is conventional in the sense that it has a back 12 and has teeth 14 extending from the back and supported by the back. The teeth generally lie in a plane and preferably are of one coarseness at one end of the comb and a different coarseness at the other end of the comb, as indicated in FIG. 2. The comb has two ends, with the reference end 16 being the end which is toward the head of the person 18 whose hair 20 is being cut. The reference end is held against the person's head during the establishment of a cutting location of a particular section of hair. The angle of the comb with respect to the person's head is indicated by the angle stop which is generally indicated at 22 in FIGS. 2, 6, 7 and 8.

In the presently preferred embodiment, the angle stop 22 is generally in the form of a hinge. Fixed flange 24, see FIG. 8, is secured to the comb back. It carries thereon fixed ferrules 26 and 28. Moving ferrule 30 lies therebetween. Pin 32 engages through all three ferrules so that moving ferrule 30 can rotate on the axis of the pin. Angle stop 34 is mounted on moving ferrule 30 and, thus, can swing around the pin axis. As seen in FIG. 8, fixed ferrule 26 has a series of detent notches therein, with detent notch 36 being particularly identified. Angle stop 34 has a spring finger 38 integrally formed therewith, see FIG. 7. The spring finger has a detent 40 thereon, see FIG. 8, which can engage in the selected detent notch to hold the angle stop at the desired angle. The detent notches 36 are preferably positioned to releasably hold the angle stop 34 in the fixed line position in FIG. 8 where it lies against the comb back 12 to a position 30, 45 and 90 degrees with respect thereto. The angle stop 34 is placed at the selected angle, 90 degrees in FIG. 6, and is held, against the head 18 so that the back of the comb indicates the direction in which a section of hair is to be combed to be measured and cut.

The angle at which the comb back extends with respect to the surface of the head at which the angle stop is engaged is the elevation, as previously described. The angle stop is adjustable in angle and, thus, the elevation angle at which the section of hair is combed with respect to the head surface can be selected.

The distance from the head at which the section of hair is to be cut must also be carefully established for a precision haircut. To aid in establishing the proper length, a finger stop is mounted on the back of the comb. The finger stop is generally indicated at 42 in FIGS. 1, 2, 3, 4 and 5. The back 12 of the comb 10 has means thereon for positioning the finger stop with respect to the reference end 16 and releasably securing it in that position. In the preferred embodiment disclosed in the application, the comb back 12 has a slot 44 therethrough. Preferably, the slot terminates intermediate the ends of the comb. As is seen in FIG. 3, the slot includes a U-shaped channel 46 in the back of the comb running along the length of the slot. The top edge of the slot is defined by a series of steep teeth 48, see FIG. 4. The back may carry indicia 50 indicating the distance from the reference end of the comb seen in FIG. 5, the finger stop includes an upright stop 52 which has an opening 54 therein to receive the upper portion of the comb back above the slot 44. Thus, the upright stop extends above the comb back, as shown in FIGS. 1, 2, 3 and 4.

The finger stop 42 includes a lower panel 56, which is fixed to upright stop 52 and which has a slide 58 which is engaged in groove 46 so as to guide the finger stop 42 in its movement along the length of the comb back. Upper panel 60 may be formed as a unitary U-shaped structure with lower panel 56, with the base of their U adhesively fastened to the upright stop 52. The outer end of the upper panel 60 is sufficiently thin, and the material is sufficiently resilient so that the upper panel 60 can be flexed toward the lower panel 56. Tooth 62 is formed on the top of upper panel 60 and is positioned to engage in the teeth 48. The angle of the teeth is such that, when tooth 62 is engaged between a pair of the teeth 48, the finger stop cannot be moved by axial force. Instead, finger pads 64 and 66 are formed on the upper and lower panels. When the pads are squeezed together, the tooth 62 is released and the finger stop 42 can be moved to the selected length from the reference end 16.

In operation, the comb 10 is used to comb out a section of hair, such as a section of hair 68. The angle stop and finger stop have been previously set. The angle stop is held against the person's head at that section of hair to assure that the angle of elevation is correct for the selected precision haircut. Thereupon, the fore finger and middle finger clamp that section of the hair close to the head and slide out on the section of the hair, holding it at moderate tension until the forefinger 70 of the haircutter touches the finger stop 42. At this point, clamping force is increased, the comb is removed, and the scissors make a cut on the side of the forefinger and middle finger clamping the hair away from the head. In this way, that section of the hair is held at the proper elevation angle and cut at the proper length. The haircutter combs out an adjacent section of the hair and repeats the procedure.

Many precision haircuts use the same elevation and/or the same hair length so that the entire haircut can be completed with little change to the angle and finger stop positions on the compass and ruler comb. On the other hand, for some haircuts the length from the reference end to the finger stop can be quickly changed, as required. Similarly, the angle stop can be quickly changed to a new selected angle so that precision haircutting is quickly and easily accomplished. In addition to the compass and ruler functions of the comb, of course the comb can be used in the actual hair combing process. The comb also carries a parting point 72, see FIG. 2, so that the comb 10 can accomplish many of the functions required in precision haircutting.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A comb for use in haircutting, comprising:

a comb back, a plurality of comb teeth extending from said comb back so that said comb is configured for the combing of hair, said comb having a reference end;

an angle stop pivotally mounted on said comb at its reference end, said angle stop including a stop member pivotally mounted on said reference end of said comb and means mounted on said reference end of said comb for releasably latching said angle stop member at a predetermined angle with respect to said back of said comb so that the hair is combed out with the comb and the combed-out hair is clamped in the fingers and hair tension is maintained while the angle stop lies against the head so that the elevation of hair with respect to the head is accurately placed during a haircutting procedure;

a detent engaging said angle stop, said detent being spring-mounted with respect to said angle stop member so that said detent can be resiliently moved out of a detent recess for repositioning the angle of said angle stop member.

2. The comb of claim 1 further including a finger stop on said comb back, said finger stop being positionable at a preselected distance with respect to said reference end.

3. A comb for use in haircutting, comprising:

a comb back, a plurality of comb teeth extending from said comb back so that said comb is configured for the combing of hair, said comb having a reference end;

an angle stop pivotally mounted on said comb at its reference end, said angle stop including a stop member pivotally mounted on said reference end of said comb;

a ferrule fixed to said comb back adjacent its reference end and a moving ferrule movably mounted with respect to said fixed ferrule, said angle stop member being fixed to said moving ferrule; and means for releasably latching said angle stop member at a predetermined angle with respect to said back of said comb so that the hair can be combed out with the comb and the combed-out hair can be clamped in the fingers and hair tension is maintained while the angle stop lies against the head so that the elevation of hair with respect to the head can be accurately placed during a haircutting procedure.

4. The comb of claim 3 wherein a pivot pin extends through both said fixed and said moving ferrule.

5. The comb of claim 4 wherein said fixed ferrule has detent notches therein and said angle stop member carries a detent thereon for selective engagement in one of said detent notches.

6. The comb of claim 5 wherein said detent is spring-mounted with respect to said angle stop member so that said detent can be resiliently moved out of a detent recess for repositioning the angle of said angle stop member.

7. The comb of claim 6 further including a finger stop on said comb back, said finger stop being positionable at a preselected distance with respect to said reference end.

8. A comb for precision haircutting comprising:

a back, a plurality of spaced comb teeth extending from said comb back, said back having a reference end;

a finger stop mounted on said back at a known distance from said reference end so that the comb can be used to comb out the hair and the combed-out hair is clamped between the fingers and hair tension is maintained so that said reference end can be placed against the head and a finger slid out on the clamped hair until the finger is against the finger stop to locate the finger at a known distance from the reference end and the head.

9. The comb of claim 8 wherein said finger stop is adjustably mounted with respect to said reference end.

10. The comb of claim 9 wherein said finger stop is movably mounted along said back to a selected position.

11. The comb of claim 10 wherein said finger stop is slidably mounted on said back.

12. The comb of claim 8 wherein said back has a slot therethrough and said slot has a channel therein extending generally longitudinally of said back of said comb, said finger stop engaging in said channel to be guided along the length of said back of said comb.

13. The comb of claim 8 wherein said back has a slot therethrough and said slot has a channel therein extending generally longitudinally of said back of said comb, said finger stop engaging in said channel to be guided along the length of said back of said comb.

14. The comb of claim 13 wherein said slot has a plurality of notches therein and said finger stop carries a detent thereon for engaging in a selected one of said notches so that said finger stop can be slid along said channel when said detent is disengaged to adjust the position of said finger stop with respect to said reference end.

15. The comb of claim 14 further including indicia on said back to indicate the distance of said finger stop from said reference end.

16. The comb of claim 15 further including an angle stop on said reference end of said comb back.

17. A comb for precision haircutting comprising:

a back, a plurality of spaced comb teeth extending from said comb back, said back having a reference end;

a finger stop mounted on said back at a known distance from said reference end said back having a plurality of spaced features therealong and said finger stop having means thereon for engaging a selected one of said spaced features so that said finger stop can be placed a selected distance from said reference end with said means engaging a selected one of said spaced features so that the comb can be used to comb out the hair and the combed-out hair is clamped between the fingers and hair tension is maintained so that said reference end can be placed against the head and a finger slid out on the clamped hair until the finger is against the finger stop to locate the finger at a known distance from the reference end and the head.

18. The comb of claim 17 wherein said spaced features are notches and wherein said means for engaging said notches comprises a tooth.

19. A comb for precision haircutting comprising:

a back, a plurality of spaced comb teeth extending from said comb back, said back having a reference end;

a finger stop mounted on said back at a known distance from said reference end, said back having a slot therethrough and said slot having a channel therein extending generally longitudinally of said back of said comb, said finger stop engaging in said channel to be guided along the length of said back of said comb, said slot having a plurality of notches therein, and said finger stop carrying a detent thereon for engaging in a selected one of said notches so that said finger stop can be slid along said channel when said detent is disengaged to adjust the position of said finger stop with respect to said reference end so that the comb can be used to comb out the hair and the combed-out hair is clamped between the fingers and hair tension is maintained so that said reference end can be placed against the head and a finger slid out on the clamped hair until the finger is against the finger stop to locate the finger at a known distance from the reference end and the head.

20. The comb of claim 19 further including indicia on said back to indicate the distance of said finger stop from said reference end.

21. The comb of claim 20 further including an angle stop on said reference end of said comb back.

22. A comb, said comb comprising:

a comb back having a reference end, a plurality of spaced teeth extending from said comb back so that said comb is configured for the combing of hair;

an angle stop member on said reference end of said comb, said angle stop member being positioned at an angle with respect to said comb back corresponding to the desired elevation angle of the hair during cutting so that the hair can be combed out with the comb and the combed-out hair can be clamped in the fingers and hair tension is maintained while the angle stop lies against the head so that when said angle stop member is placed against the head said comb back and hair are positioned at the desired elevation angle; and a finger stop on said comb back, said finger stop being positioned at a desired distance from said reference end so that when the fingers clamped on the hair are slid out against said finger stop, the fingers are at the desired distance from the head for cutting hair adjacent the fingers.

23. The comb of claim 22 wherein said angle stop is adjustable with respect to said comb back so that the desired elevation angle can be selected.

24. The comb of claim 22 wherein said finger stop is adjustable along said back with respect to said reference end of said comb back so that the length of hair from said reference end to said finger stop can be preselected.

25. The comb of claim 24 wherein said angle stop is adjustable with respect to said comb back so that the desired elevation angle can be selected.

* * * * *